US011610561B1

(12) United States Patent
Chan et al.

(10) Patent No.: US 11,610,561 B1
(45) Date of Patent: Mar. 21, 2023

(54) HUB SYSTEM CONTROL METHOD AND HUB PERFORMING THE HUB SYSTEM CONTROL METHOD

(71) Applicant: ATEN INTERNATIONAL CO., LTD., New Taipei (TW)

(72) Inventors: Kai-Jui Chan, New Taipei (TW); Chih-Wei Huang, New Taipei (TW); Shang-Yi Yang, New Taipei (TW)

(73) Assignee: ATEN INTERNATIONAL CO., LTD., New Taipei (TW)

( * ) Notice: Subject to any disclaimer, the term of this patent is extended or adjusted under 35 U.S.C. 154(b) by 0 days.

(21) Appl. No.: 17/711,051

(22) Filed: Apr. 1, 2022

(30) Foreign Application Priority Data

Sep. 6, 2021 (TW) ..... 110133024

(51) Int. Cl.
*G09G 5/00* (2006.01)

(52) U.S. Cl.
CPC ..... *G09G 5/006* (2013.01); *G09G 2320/08* (2013.01); *G09G 2350/00* (2013.01); *G09G 2360/04* (2013.01); *G09G 2360/12* (2013.01); *G09G 2370/047* (2013.01); *G09G 2370/24* (2013.01)

(58) Field of Classification Search
CPC ..... G09G 2350/00; G09G 5/14; G09G 2340/0435; G09G 2370/20; G09G 2370/042; G09G 2340/0407; G09G 2370/022; G09G 2354/00; G09G 2370/047; G09G 2360/04; G09G 2340/14; G09G 2300/026; G09G 2370/10; G09G 2370/24
See application file for complete search history.

(56) References Cited

U.S. PATENT DOCUMENTS

| | | | | |
|---|---|---|---|---|
| 2011/0074954 | A1 | 3/2011 | Lin | |
| 2018/0226052 | A1* | 8/2018 | Lv | G09G 5/006 |
| 2020/0076696 | A1 | 3/2020 | Helvey | |
| 2021/0136322 | A1* | 5/2021 | Zhao | H04N 21/4402 |
| 2021/0173604 | A1* | 6/2021 | Park | G09F 27/00 |

FOREIGN PATENT DOCUMENTS

| | | |
|---|---|---|
| TW | 200613973 | 5/2006 |

* cited by examiner

*Primary Examiner* — Sanjiv D. Patel
(74) *Attorney, Agent, or Firm* — Winston Hsu

(57) ABSTRACT

A hub system control method, for controlling a hub which has a maximum bandwidth and is connected to a plurality of monitors, comprising: acquiring resolutions and refresh rates of each one of the monitors by the hub; computing used bandwidths of each one of the monitors according to the resolutions and the refresh rates; and controlling the hub to operate corresponding to at least one relation between the used bandwidths and the maximum bandwidth.

15 Claims, 5 Drawing Sheets

HUB SYSTEM CONTROL METHOD AND HUB PERFORMING THE HUB SYSTEM CONTROL METHOD

BACKGROUND OF THE INVENTION

1. Field of the Invention

The present invention relates to a hub system control method and a hub, and particularly relates to a hub system control method and a hub which can control hubs according to a used bandwidth of the monitor.

2. Description of the Prior Art

In the prior art, when multiple monitors are used, a hub is usually used to connect the multiple monitors and an image source, so that the multiple monitors can display images provided by the image source. Under the multi-stream transport (MST) architecture, different monitors can display different contents, but under the single stream transport (SST) architecture, different monitors only can display the same contents.

However, when each monitor displays images, it occupies a part of the bandwidth of the hub (hereinafter referred to as the used bandwidth). When the sum of the used bandwidth of all monitors exceeds the maximum available bandwidth of the hub, at least one monitor cannot display the screen. However, the steps of setting the bandwidth of multiple monitors in the prior art are quite inconvenient. For example, one of the multiple monitors can display a main screen so that the user can set the resolutions of all the monitors via the main screen. However, the user may not know the relation between the resolution and the used bandwidth thus does not know how to set it. Moreover, if the monitor which cannot display the screen comprises the monitor originally used to display the main screen, it will be more difficult for the user to adjust the resolution of the multiple monitors.

SUMMARY OF THE INVENTION

One objective of the present invention is to provide a hub system control method, by which the user can easily acquire suggestion for setting resolutions.

Another objective of the present invention is to provide a hub system control method, by which more monitors can be used and users can also set the resolutions of all monitors through any one of the hubs.

One embodiment of the present invention discloses a hub system control method, for controlling a hub which has a maximum bandwidth and is connected to a plurality of monitors, comprising: acquiring resolutions and refresh rates of each one of the monitors by the hub; computing used bandwidths of each one of the monitors according to the resolutions and the refresh rates; and controlling the hub to operate corresponding to at least one relation between the used bandwidths and the maximum bandwidth. The present invention further provides a hub which performs this hub system control method.

Another embodiment of the present invention discloses a hub system control method, for controlling a hub system which comprises a first hub and a second hub which is connected to a plurality of first monitors and the first hub, wherein the first hub has a first maximum bandwidth and the second hub has a second maximum bandwidth, the hub system control method comprising: acquiring resolutions and refresh rates of each one of the first monitors by the first hub; computing first used bandwidths of each one of the first monitors according to the resolutions and the refresh rates by the first hub; and controlling the first hub to correspondingly operate or controlling operations of the first hub via the second hub, according to at least one first relation between the first used bandwidths and the first maximum bandwidth or at least one second relation between the first used bandwidths and the second maximum bandwidth.

In view of above-mentioned embodiments, the user can easily set the resolutions or refresh rates of multiple monitors, thus the difficulty of setting the resolutions of multiple monitors in the prior art can be reduced. In addition, by connecting a hub to other hubs, more available monitors can be used, and users can also set the resolutions of all monitors through any one of the hubs.

These and other objectives of the present invention will no doubt become obvious to those of ordinary skill in the art after reading the following detailed description of the preferred embodiment that is illustrated in the various figures and drawings.

DETAILED DESCRIPTION

Several embodiments are provided in following descriptions to explain the concept of the present invention. Each component in following descriptions can be implemented by hardware (e.g. a device or a circuit) or hardware with software (e.g. a program installed to a processor). Besides, the method in following descriptions can be executed by programs stored in a non-transitory computer readable recording medium such as a hard disk, an optical disc or a memory. Additionally, the term "first", "second", "third" in following descriptions are only for the purpose of distinguishing different one elements, and do not mean the sequence of the elements. For example, a first device and a second device only mean these devices can have the same structure but are different devices.

Figure 1:
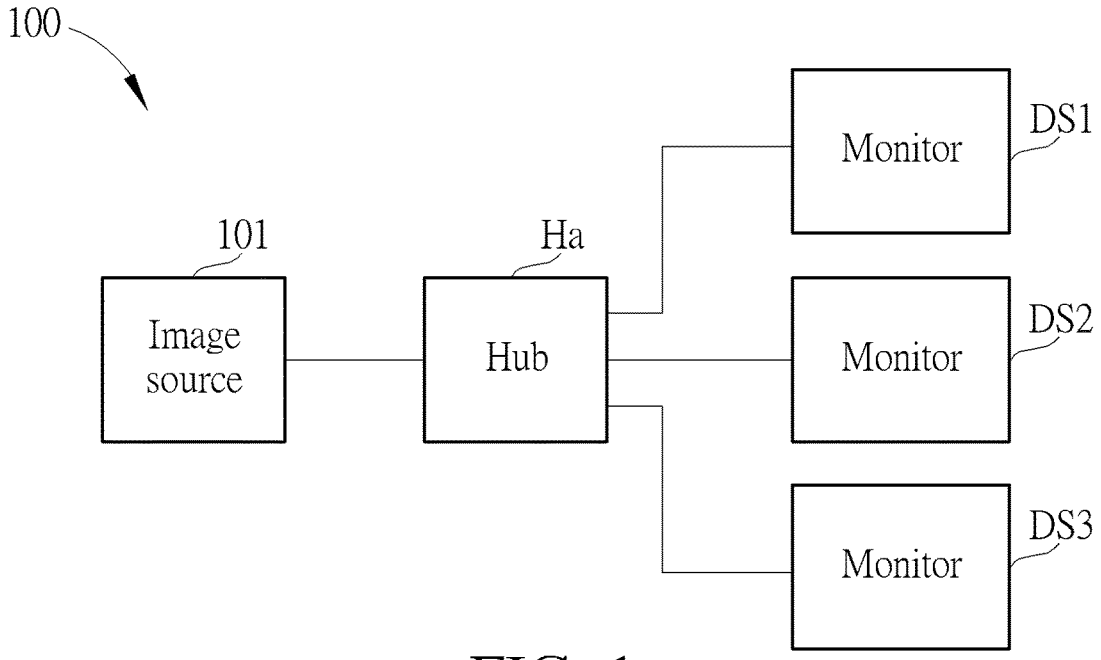
FIG. 1 is a schematic diagram illustrating a hub system according to one embodiment of the present invention.

FIG. 1 is a schematic diagram illustrating a hub system according to one embodiment of the present invention. As shown in FIG. 1, the hub system 100 comprises a hub Ha, which is connected to the image source 101 and a plurality of monitors (in this example, three monitors DS1, DS2, DS3, but not limited), and the monitors DS1, DS2, DS3 which display images according to the images provided by the image source 101. The monitors DS1, DS2, and DS3 can display the same image or different images. The image source 101 can be various electronic devices, such as a host computer, a notebook computer, a mobile device, and so on.

The hub Ha acquires the resolutions and refresh rates of the monitors DS1, DS2, and DS3, and computes the used bandwidths of the monitors DS1, DS2, DS3 based on the resolutions and refresh rates. Also, the hub Ha operates according to a relation between a maximum bandwidth and the used bandwidths. Its technical contents are described for more details below. In one embodiment, the hub Ha receives EDID (Extended display identification data) from the monitors DS1, DS2, and DS3 to acquire the resolutions and refresh rates. Also, in one embodiment, a look-up table can be used to compute the corresponding used bandwidths according to the resolutions and refresh rates. For example, if the resolution of the monitor is 1920×1080 and the refresh rate is 60 Hz, the used bandwidth of this monitor is 3.2 Gbit/s, and if the resolution of the monitor is 3840×2160 and the refresh rate is 75 Hz, then the used bandwidth of the monitor is 15.79 Gbit/s. However, the computation of used bandwidths is not limited to these examples.

Figure 2:
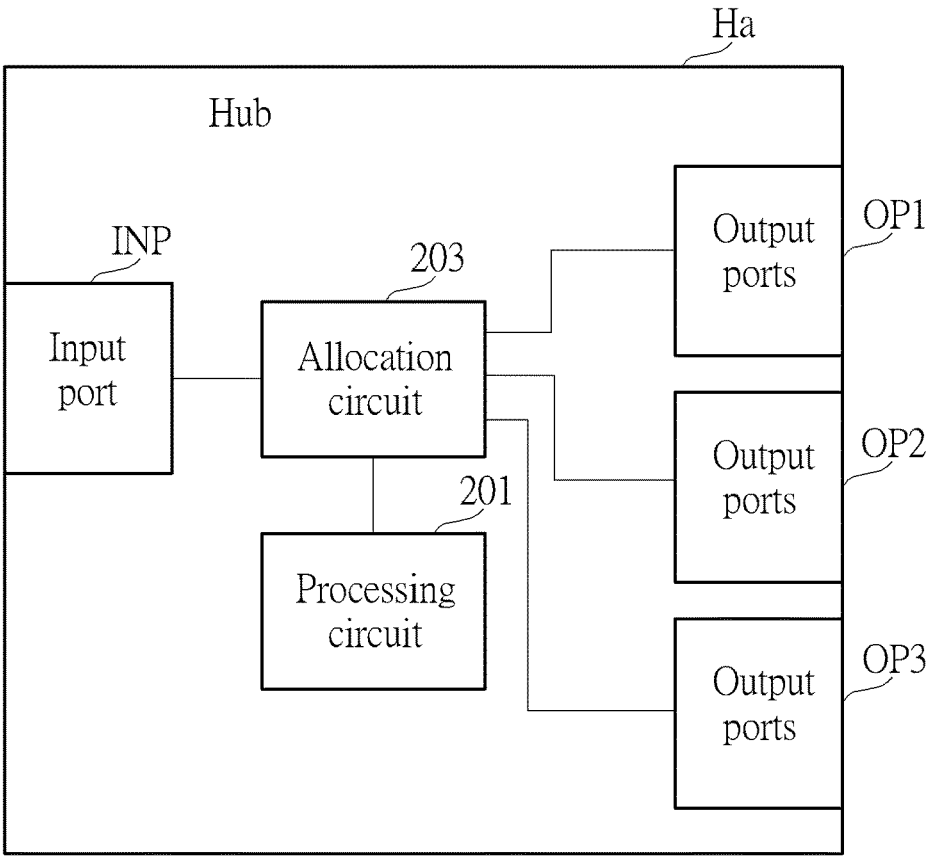
FIG. 2 is a schematic diagram illustrating a detail structure of a hub according to one embodiment of the present invention.

FIG. 2 is a schematic diagram illustrating a detail structure of a hub according to one embodiment of the present invention. Please note that FIG. 2 is only for example, and hubs with other structures that can achieve the same function can also be used in the present invention. As shown in FIG. 2, the hub Ha comprises an input port INP, a processing circuit 201, an allocation circuit 203, and output ports OP1, OP2, and OP3. The input port INP is used to connect the image source 101 in FIG. 1, and the output ports OP1, OP2, OP3 are connected to the monitors DS1, DS2, and DS3. The allocation circuit 203 is used to switch the transmission path between the input port INP and the output ports OP1, OP2, OP3. The processing circuit 201 is used to control the operations of the allocation circuit 203 and other operations of the hub Ha. The allocation circuit 203 can be a switch, FPGA, or other circuits which can allocate the connections between the input port INP and the output ports OP1, OP2, OP3.

Figure 3:
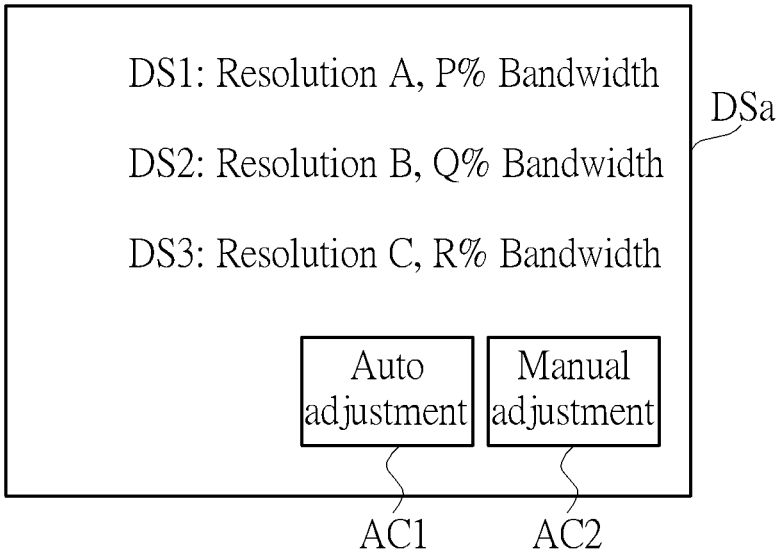
FIG. 3-FIG. 5 are schematic diagrams illustrating hub system operations according to different embodiments of the present invention.
Figure 4:
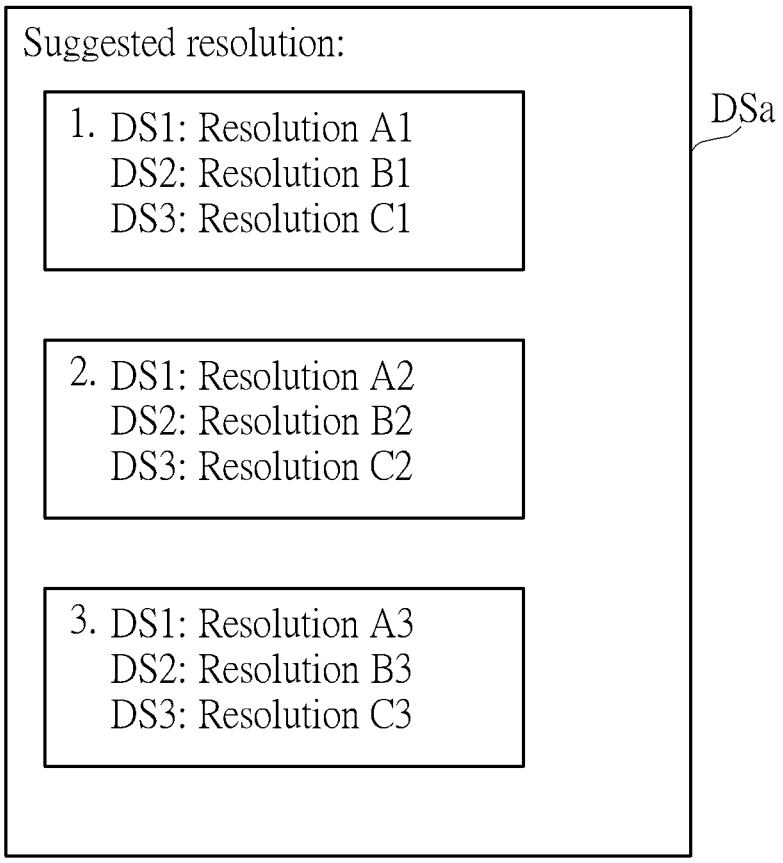
Figure 5:
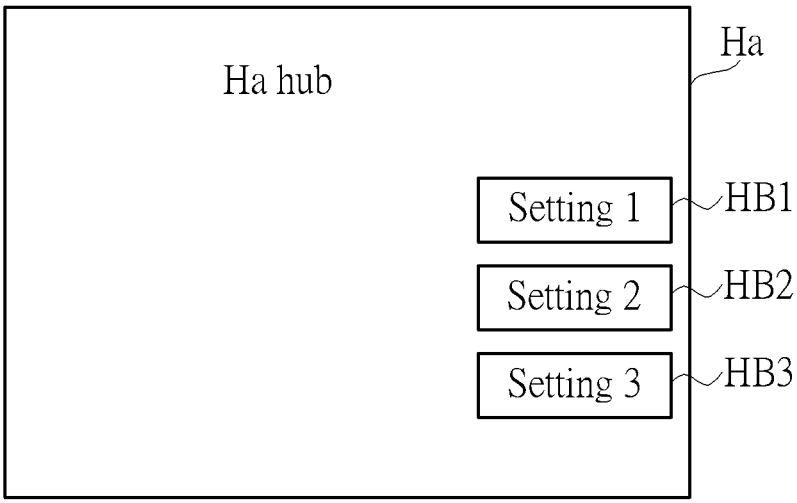

In following descriptions, embodiments of "the hub Ha operates corresponding to the relation" are described. These embodiments comprise operations that the hub Ha actively performs and operations that the user controls the hub Ha to perform. Also, "the relation" can be the ratio between the used bandwidths and the maximum bandwidth, or the difference between the used bandwidths and the maximum bandwidth. In addition, in the following embodiments, the used bandwidth of the monitor is adjusted by "adjusting the resolution". However, the used bandwidth of the monitor can also be adjusted by adjusting the refresh rate, and the used bandwidth of the monitor can also be adjusted by adjusting the resolution and refresh rate at the same time. However, please understand that these embodiments are only examples and do not mean to limit the present invention. Persons skilled in the art can arbitrarily change, combine or divide the contents disclosed in FIGS. 3 to 5 for different applications, and such changes should fall within the scope of the present invention. FIG. 3-FIG. 5 are schematic diagrams illustrating hub system operations according to different embodiments of the present invention. In FIG. 3, the hub Ha controls a monitor DSa to display these relations. The monitor DSa may be a monitor provided on the hub Ha, or a monitor capable of displaying images such as the monitors DS1, DS2, and DS3. In one embodiment, the user can write programs into the hub Ha to set the resolutions of the monitors DS1, DS2, and DS3 according to the displayed relations on the monitor DSa.

For example, in the embodiment shown in FIG. 3, the monitor DSa displays a user interface, which comprises the resolutions of the monitors DS1, DS2, and DS3 and the ratios of the used bandwidths and the maximum bandwidth. In addition, in one embodiment, the monitor DSa further displays icons AC1 and AC2. The user can trigger the icon AC1 to allow the hub Ha to automatically adjust (update) the resolutions in the monitors DS1, DS2, and DS3. Alternatively, the user can manually adjust the resolutions by triggering the icon AC2. The manual adjustment can be achieved in various ways, for example, the user can input the resolutions of the monitor DS1, DS2, DS3. In this example, the pre-stored look-up table can be displayed so that the user can inquire the corresponding used bandwidths of each monitor DS1, DS2, DS3 while inputting the resolutions. Alternatively, the monitor DSa can also display several resolutions for the user to select.

In one embodiment, the hub Ha may notify the user of the relation between the used bandwidths of each monitor and the maximum bandwidth of the hub Ha in other ways. For example, when the total used bandwidth exceeds the maximum bandwidth or a proportion of the maximum bandwidth (for example, 50%), the hub Ha uses light emitting devices to emit light or to generate sound to notify the user that the total bandwidth exceeds the maximum bandwidth, or exceeds a proportion of the maximum bandwidth.

In another embodiment, the hub Ha generates a prompt message after computing the used bandwidths of the monitors DS1, DS2, and DS3, which can prompt the recommended bandwidth. This prompt message can be displayed on the monitor DSa described in FIG. 3. As shown in FIG. 4, the monitor DSa displays several recommended resolutions, and the total bandwidth of all the recommended resolutions does not exceed the maximum bandwidth of the hub Ha. The user can click one of them to set the resolutions of the monitors DS1, DS2, and DS3. By this method, the user can easily set the resolutions of the monitors DS1, DS2, and DS3 even if they do not know the corresponding relations between the resolutions and the used bandwidths. In one embodiment, when the user triggers the icon AC2 in FIG. 3, it can be switched to the displayed screen in FIG. 4.

The user is not limited to use the user interface displayed on the monitor to set the resolutions of each monitor. In the embodiment of FIG. 5, the hub Ha has several hardware buttons HB1, HB2, and HB3, which correspond to Setting 1, Setting 2, and Setting 3, respectively. Setting 1, Setting 2, and Setting 3 respectively comprise different setting combinations, such as the setting combination shown in FIG. 4. After the user triggers one of the hardware buttons HB1, HB2, and HB3, the resolutions of each monitor can be set to the setting combination corresponding to the triggered hardware button. In another embodiment, the hub Ha can generate a prompt message to suggest which setting combination the user should use. For example, the hardware buttons HB1, HB2, and HB3 correspond to different light emitting devices, and the hub Ha makes the light emitting device corresponding to the recommended hardware button emit light to suggest the user which one of the setting combination should be used.

Figure 6:
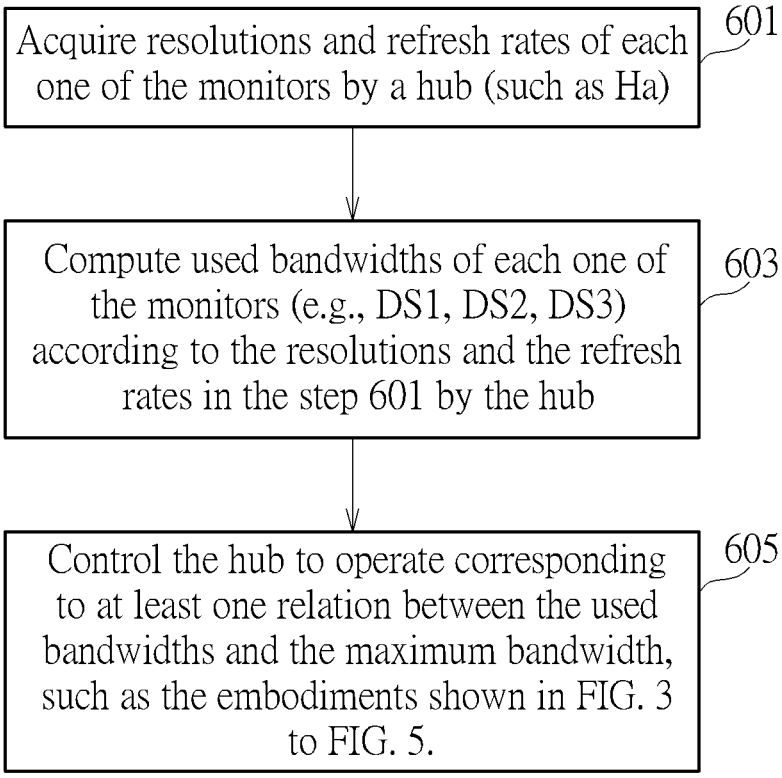
FIG. 6 is a flow chart illustrating a hub system control method corresponding to FIG. 1, according to one embodiment of the present invention.

According to the foregoing embodiment, a hub system control method for controlling a hub system can be acquired. The hub system comprises a hub Ha connected to a plurality of monitors. The hub Ha has a maximum bandwidth. FIG. 6 is a flow chart illustrating a hub system control method corresponding to FIG. 1, according to one embodiment of the present invention, which corresponds to the embodiment shown in FIG. 1 and comprises the following steps:

Step 601

Acquire resolutions and refresh rates of each one of the monitors by a hub (such as Ha).

Step 603

Compute used bandwidths of each one of the monitors (e.g., DS1, DS2, DS3) according to the resolutions and the refresh rates in the step 601 by the hub.

Step 605

Control the hub to operate corresponding to at least one relation between the used bandwidths and the maximum bandwidth, such as the embodiments shown in FIG. 3 to FIG. 5.

Please also note that the step of "operate corresponding to at least one relation" here is not limited to operate corresponding to only relation, and it can also operate corresponding to a plurality of relations.

Other detailed steps are described in foregoing embodiments, thus are omitted for brevity here.

Figure 7:
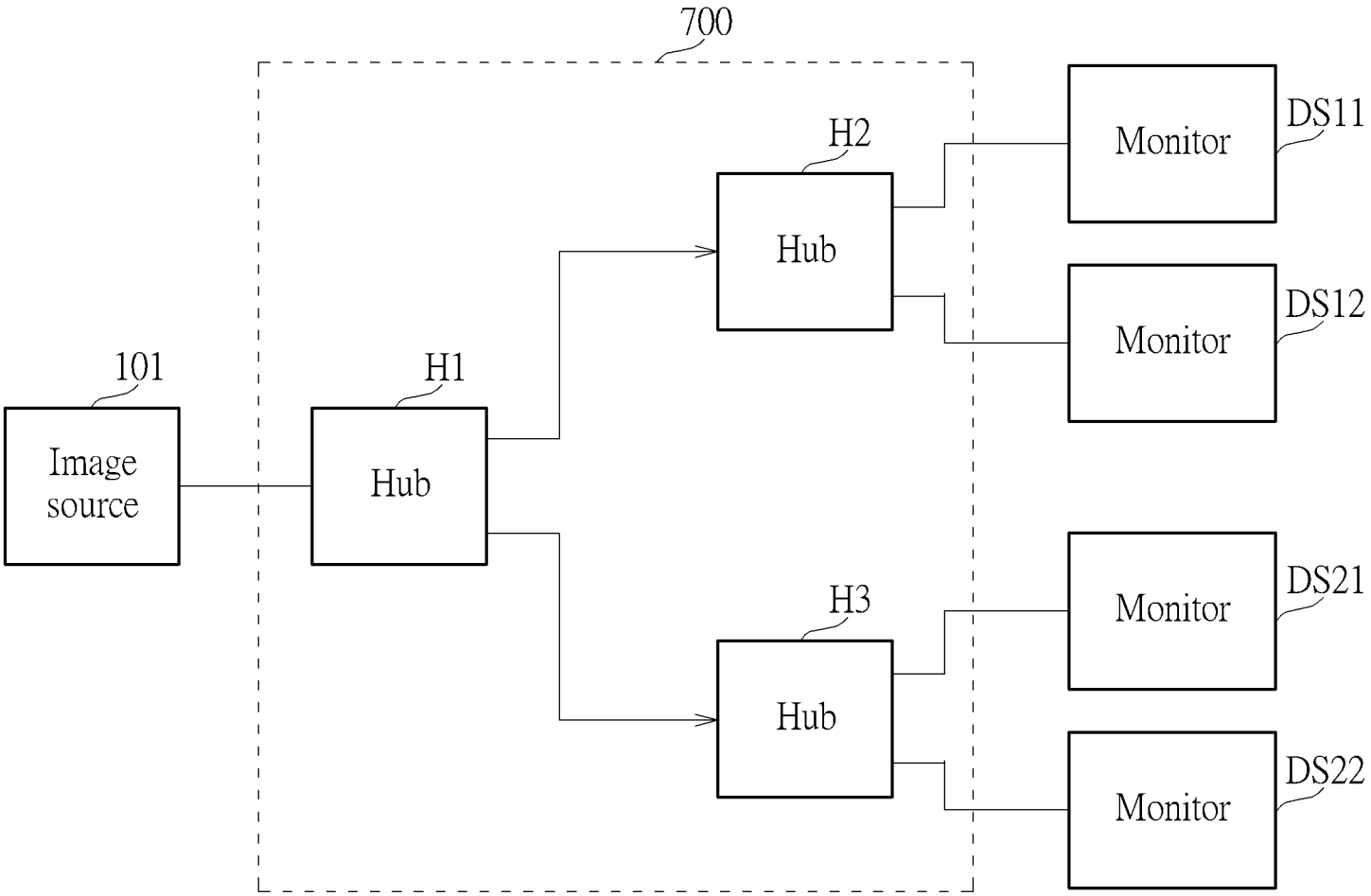
FIG. 7 is a schematic diagram illustrating a hub system according to another embodiment of the present invention.

The above-mentioned hub system may comprise multiple hubs. FIG. 7 is a schematic diagram illustrating a hub system according to another embodiment of the present invention. As shown in FIG. 7, the hub system 700 comprises a first hub H1, a second hub H2, and a third hub H3. The first hub H1 has a first maximum bandwidth, and is connected to the second hub H2 and the third hub H3. The second hub H2 has a second maximum bandwidth and is connected to the first monitors DS11 and DS12. The third hub H3 has a third maximum bandwidth and is connected to the second monitors DS23 and DS24. However, the second hub H2 and the third hub H3 are not limited to being connected to two monitors.

In the embodiment of FIG. 7, if only the second hub H2 is comprised and the third hub H3 is not comprised, the first hub H1 acquires the resolutions and refresh rates of the first monitor DS11 and DS12, and then respectively compute the first used bandwidths of the first monitors DS11 and DS12 according to the acquired resolutions and refresh rates. After the first used bandwidths are computed, the first hub H1 can correspondingly operate or the operations of the second hub H2 can be controlled by the first hub H1, according to the first relation between the first used bandwidths and the first maximum bandwidth or the second relation between the first used bandwidths and the second maximum bandwidth. For example, if the sum of the first used bandwidths exceeds the second maximum bandwidth, or the sum of the first used bandwidths exceeds the first maximum bandwidth, the first hub H1 may display the user interface as shown in FIG. 3. Also, after the user triggers the icon AC1 or AC2 as in the foregoing embodiment, the first hub H1 can correspondingly control the second hub H2 to set the resolution of the first monitors DS11 and DS12. Alternatively, the user can write a program to the first hub H1 according to the information contained in the user interface to set the resolutions of the first monitor DS11, DS12. This embodiment can also use the embodiment of FIG. 4 to provide a setting combination for the user to select the resolutions of the first monitor DS11, DS12. This embodiment can also use the embodiment of FIG. 5, that is, the user can set the resolutions of the first monitors DS11 and DS12 through the hardware buttons on the first hub H1. The hardware buttons can also be provided on the second hub H2, that is, the user can set the resolutions of the first monitor DS11, DS12 through the hardware buttons on the second hub H2.

In one embodiment, an auxiliary channel (such as AUX channel) exists between the first hub H1 and the second hub H2 and is used as a communication channel. The first hub H1 acquires EDID of the first monitors DS1, DS2 through the auxiliary channel, to acquire the resolutions of the first monitors DS1 and DS2.

When the embodiment of FIG. 7 comprises the second hub H2 and the third hub H3, the third hub H3 may also follow the aforementioned rules. In such embodiment, the first hub H1 acquires the resolutions and refresh rates of the first monitors DS11, DS12 and the second monitors DS21, DS22. Also, the first hub H1 computes first used bandwidths of each one of the first monitors DS11, DS12 according to the resolutions and the refresh rates, and computes second used bandwidths of each one of the second monitors DS21, DS22 according to the resolutions and the refresh rates. Besides, the first hub H1 correspondingly operate or is controlled via one of the second hub H2 and the third hub H3, according to a third relation between the first maximum bandwidth and a sum of the second used bandwidths and the first used bandwidths, or according to at least one fourth relation between the second used bandwidths and the third maximum bandwidth.

For example, when the sum of first used bandwidths and second used bandwidths exceeds the first maximum bandwidth (the third relation), or the sum of second used bandwidths exceeds the third maximum bandwidth (fourth relation), the first hub H1 can display the user interface as shown in FIG. 3. Also, after the user triggers the icons AC1 or AC2 as in the previous embodiments, the first hub H1 can correspondingly control the second hub H2 to control the resolutions of the first monitors DS11 and DS12 or control the third hub H3 to control the resolutions of the second monitors DS21, DS22. This embodiment can be applied to the embodiment of FIG. 4 to provide a setting combination for the user to select the resolutions of the first monitor DS11, DS12 and the second monitor DS21, DS22. This embodiment can also be applied to the embodiment of FIG. 5, that is, the user can set the resolutions of the first monitors DS11, DS12 or the second monitors DS21, DS22 through the hardware buttons on the first hub H1. The hardware buttons can also be provided on the second hub H2 or the third hub H3, that is, the user can set the resolutions of the first monitor DS11, DS12 through the hardware buttons on the second hub H2 and set the resolutions of the second monitor DS21, DS22 through the hardware buttons on the third hub H3.

In one embodiment, the third hub H3 or the first hub H1 can be controlled through the second hub H2, and the second hub H2 or the first hub H1 can also be controlled through the third hub H3. For example, the user can set the resolutions of the second monitors DS21 and DS22 connected to the third hub H3 through the hardware buttons on the second hub H2, or sets the resolutions of the second monitors DS21 and DS22 connected to the second hub H2 through the hardware buttons on the third hub H3. Alternatively, the user can write a program to the second hub H2 to set the resolutions of the second monitors DS21, DS22 connected to the third hub H3, or write a program to the third hub H3 to set the resolutions of the first monitors DS11, DS12 connected to the second hub H2. The user can also set the bandwidth allocated by the first hub H1 to the second hub H2 and the third hub H3 through the buttons of the second hub H2 and the third hub H3, or write a program to the second hub H2 and the third hub H3 to set the bandwidth allocated by the first hub H1 to the second hub H2 and the third hub H3.

In view of the embodiment in FIG. 7, the user can control multiple hubs through a single hub (for example, the first hub H1) to control more monitors.

Figure 8:
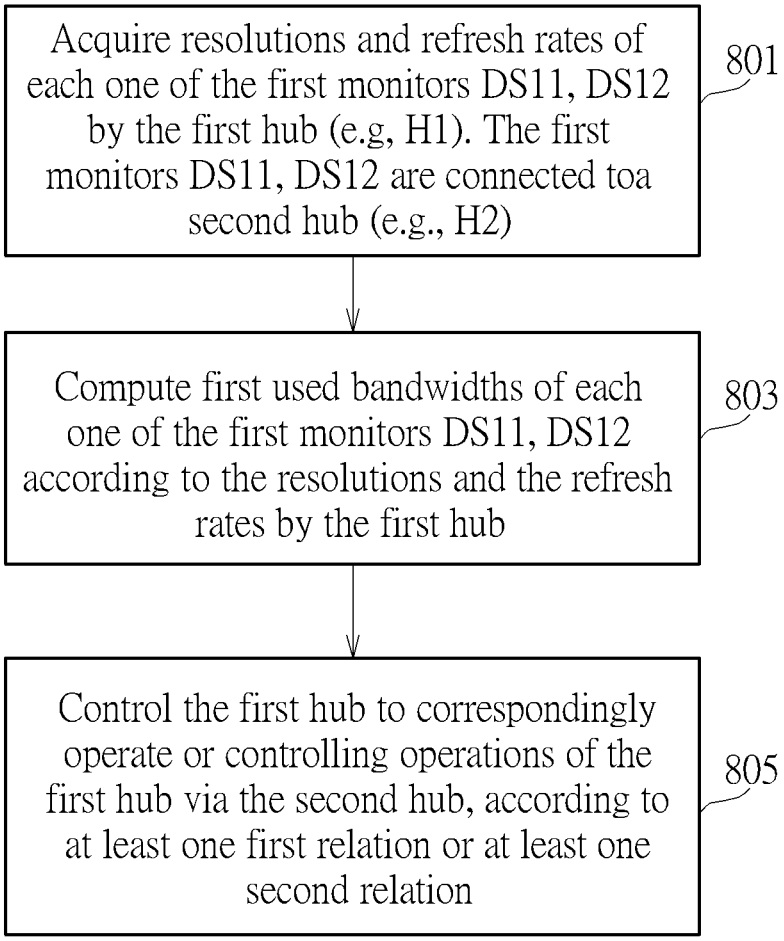
FIG. 8 is a flow chart illustrating a hub system control method corresponding to FIG. 7, according to one embodiment of the present invention.

Based on the embodiment in FIG. 7, a hub system control method can be acquired. FIG. 8 is a flow chart illustrating a hub system control method corresponding to FIG. 7, according to one embodiment of the present invention, which corresponds to a case that the third hub H3 is not comprised in the embodiment shown in FIG. 7. The hub system control method shown in FIG. 8 comprises following steps:

Step 801

Acquire resolutions and refresh rates of each one of the first monitors DS11, DS12 by the first hub (e.g, H1). The first monitors DS11, DS12 are connected to a second hub (e.g., H2)

Step 803

Compute first used bandwidths of each one of the first monitors DS11, DS12 according to the resolutions and the refresh rates by the first hub.

Step 805

Control the first hub to correspondingly operate or controlling operations of the first hub via the second hub, according to at least one first relation or at least one second relation.

Other detailed steps are illustrated in above-mentioned embodiments, thus are omitted for brevity here.

In view of above-mentioned embodiments, the user can easily set the resolutions or refresh rates of multiple monitors, thus the difficulty of setting the resolutions of multiple monitors in the prior art can be reduced. In addition, by connecting a hub to other hubs, more available monitors can be used, and users can also set the resolutions of all monitors through any one of the hubs.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A hub system control method, for controlling a hub which has a maximum bandwidth and is connected to a plurality of monitors, comprising:

acquiring resolutions and refresh rates of each one of the monitors by the hub;

computing used bandwidths of each one of the monitors according to the resolutions and the refresh rates; and controlling the hub to operate corresponding to at least one relation between the used bandwidths and the maximum bandwidth.

2. The hub system control method of claim 1, wherein the step of operate corresponding to at least one relation comprises displaying the relation on a displayed screen via the hub.

3. The hub system control method of claim 1, further comprising:

generating a prompt message according to the relation, wherein the prompt message indicates a suggested resolution setting or a suggested refresh rate setting.

4. The hub system control method of claim 1, further comprising:

updating at least one of the resolutions or at least one of the refresh rates of at least one of the monitors according to the relation.

5. A hub system control method, for controlling a hub system which comprises a first hub and a second hub which is connected to a plurality of first monitors and the first hub, wherein the first hub has a first maximum bandwidth and the second hub has a second maximum bandwidth, the hub system control method comprising:

acquiring resolutions and refresh rates of each one of the first monitors by the first hub;

computing first used bandwidths of each one of the first monitors according to the resolutions and the refresh rates by the first hub; and controlling the first hub to correspondingly operate or controlling operations of the first hub via the second hub, according to at least one first relation between the first used bandwidths and the first maximum bandwidth or at least one second relation between the first used bandwidths and the second maximum bandwidth.

6. The hub system control method of claim 5, further comprising:

applying an auxiliary channel between the first hub and the second hub to acquire the resolutions or the refresh rates of each one of the first monitors; and applying the auxiliary channel as a communication channel between the first hub and the second hub.

7. The hub system control method of claim 5, further comprising:

setting at least one of the resolution or at least one of the refresh rate of at least one of the first monitors by the first hub.

8. The hub system control method of claim 5, further comprising:

updating at least one of the resolution or at least one of the refresh rate of at least one of the first monitors according to the first relation or the second relation by controlling the second hub via the first hub.

9. The hub system control method of claim 5, wherein the hub system further comprises a third hub, wherein the third hub is connected to a plurality of second monitors and has a third maximum bandwidth, the hub system control method further comprising:

acquiring resolutions and refresh rates of each one of the second monitors by the first hub;

computing second used bandwidths of each one of the second monitors according to the resolutions and the refresh rates of the second monitors by the first hub;

controlling the first hub to correspondingly operate or controlling operations of the first hub via one of the second hub and the third hub, according to a third relation between the first maximum bandwidth and a sum of the second used bandwidths and the first used bandwidths, or according to at least one fourth relation between the second used bandwidths and the third maximum bandwidth.

10. The hub system control method of claim 5, wherein the hub system further comprises a third hub, wherein the third hub is connected to a plurality of second monitors and has a third maximum bandwidth, the hub system control method further comprising:

acquiring resolutions and refresh rates of each one of the second monitors by the first hub;

computing second used bandwidths of each one of the second monitors according to the resolutions and the refresh rates of the second monitors by the first hub;

controlling operations of the second hub via the third hub, according to a third relation between the first maximum bandwidth and a sum of the second used bandwidths and the first used bandwidths, or according to at least one fourth relation between the second used bandwidths and the third maximum bandwidth.

11. A hub, having a maximum bandwidth, comprising:

a plurality of output ports, configured to connect to a plurality of monitors; and a processing circuit, configured to perform following steps:

acquiring resolutions and refresh rates of each one of the monitors;

computing used bandwidths of each one of the monitors according to the resolutions and the refresh rates; and controlling the hub to operate corresponding to at least one relation between the used bandwidths and the maximum bandwidth.

12. The hub of claim 11, wherein the processing circuit acquires the resolutions and the refresh rates via EDID (Extended display identification data) of the monitors.

13. The hub of claim 11, wherein the step of operate corresponding to at least one relation comprises displaying the relation on a displayed screen via the hub.

14. The hub of claim 11, wherein the processing circuit is further configured to generate a prompt message according to the relation, wherein the prompt message indicates a suggested resolution setting or a suggested refresh rate setting.

15. The hub system control method of claim 11, wherein the processing is further configured to update at least one of the resolutions or at least one of the refresh rates of at least one of the monitors according to the relation.

* * * * *